US006148918A

United States Patent [19]

Alexander

[11] Patent Number: 6,148,918

[45] Date of Patent: Nov. 21, 2000

[54] WELLBORE CLEANING TOOL AND METHOD

[76] Inventor: G. Timmins Alexander, 800 Rue Rampart, Suite 301, Metairie, La. 70005

[21] Appl. No.: 09/261,419

[22] Filed: Mar. 3, 1999

[51] Int. Cl.[7] ..... E21B 37/02

[52] U.S. Cl. ..... 166/311; 166/173; 166/242.1

[58] Field of Search ..... 166/311, 172, 166/173, 242.1

[56] References Cited

U.S. PATENT DOCUMENTS

| | | | |
|---|---|---|---|
| 1,596,422 | 8/1926 | Fulton | 166/173 |
| 2,634,813 | 4/1953 | Wright | 166/173 |
| 2,868,298 | 1/1959 | Gist | 166/173 |
| 2,868,299 | 1/1959 | Gist | 166/173 |
| 3,038,540 | 6/1962 | Atkinson | 166/170 |
| 3,083,772 | 4/1963 | Tripplehorn | 166/176 |
| 3,087,550 | 4/1963 | Tyrrell, Jr. | 166/173 |
| 3,109,492 | 11/1963 | Solum et al. | 166/172 |
| 3,124,198 | 3/1964 | Solum et al. | 166/173 |
| 3,357,494 | 12/1967 | Bolding, Sr. | 166/173 |
| 3,390,725 | 7/1968 | Alexander, Jr. | 166/173 |
| 3,858,653 | 1/1975 | Turbyfill | 166/173 |
| 4,159,742 | 7/1979 | Alexander, Jr. | 166/173 |
| 4,750,558 | 6/1988 | Alexander, Jr. | 166/173 |

*Primary Examiner*—Hoang Dang
*Attorney, Agent, or Firm*—Keaty Professional Law Corporation

[57] ABSTRACT

A well bore cleaning tool adapted for close tolerance well bores is provided comprising a plurality of cylindrical collars attached to an elongated cable by a plurality of corresponding bent sleeves. The collars are adapted for detachable securing on a casing pipe in a vertically spaced apart relationship to each other. Each sleeve is fixedly secured within a cutout of a corresponding collar by a strip juxtaposed over an exterior surface of the sleeve, opposing ends of the strip extending beyond the cutout for attachment to the corresponding collar, such that a minimal portion of the sleeve extends beyond an outside diameter of the collar. The elongated cable is threaded through the sleeves of the collars such that the cable extends along and in close proximity to the casing pipe, to thereby facilitate cleaning of a well bore in close tolerance conditions.

19 Claims, 1 Drawing Sheet

WELLBORE CLEANING TOOL AND METHOD

FIELD OF THE INVENTION

The present invention relates to devices and methods for cleaning well bores, and more particularly to devices and methods for cleaning well bores in close tolerance conditions.

BACKGROUND OF THE INVENTION

In drilling operations for oil and gas wells, a well bore is formed by drilling through geographic strata. In the drilling process, a pipe casing is positioned within the well bore. The region or space between the outside diameter of the pipe casing and the inner wall of the well bore is termed the annulus. As the depth of the well increases, increasing pressures make it necessary to use smaller bores and smaller pipe casings, resulting in a progressive decrease in the size of the annulus with the depth of the well bore. Sections of well bores that have a small annulus, such as ½ to ¾ of an inch, are commonly referred to as "close tolerance conditions."

Unique problems are encountered when working in close tolerance conditions, including problems with cleaning the well bore prior to carrying out cementing operations. Three basic types of cementing operations are used in the drilling and completion of oil and gas wells: (1) casing or primary cementing; (2) squeeze cementing; and (3) setting of cement plugs.

Casing or primary cementing is used to seal the annulus between the pipe casing and bore hole so that fluids in permeable layers of the surrounding strata may not migrate vertically within the annulus. This procedure involves pumping a desired volume of cement slurry down the casing and back up the annular space a required distance toward the surface. It has been demonstrated and documented in both laboratory testing and field operations that rotation of the pipe casing during primary cementing is one of the most important factors in obtaining successful primary cement jobs.

Squeeze cementing is used when "channeling" or partial bypassing of the cement slurry past the drilling mud media in the well bore results in primary cement jobs of poor quality. If the primary cementing of the casing was inadequate in sealing or supporting the casing string, it is necessary to employ squeeze cementing. Squeeze cementing involves pumping of cement slurry under very high pressure through holes perforated in the pipe casing at precise levels. Squeeze cementing can reduce the oil or gas producing capability of a well due to filling of the permeable section of the reservoir rock with drilling mud and cement. Squeeze cementing is also very costly from the standpoint of the additional time and expense of the extra operations required.

The setting of cement plugs is the third type of cementing operation sometimes required in the drilling of oil and gas wells. Setting of cement plugs consists of filling up the drilled well bore over a specified interval, usually ranging from a few hundred feet to a few thousand feet or more in length with cement in order to create a cement plug.

A cement plug can be used to abandon a well found to be dry or depleted of oil or gas, to change the direction of drilling in order to drill around a section of drill pipe or casing that has become "stuck" and prevented deeper drilling, or to direct the drilling of the well bore in a different direction to a more favorable subsurface position in order to find the oil or gas reservoir. In setting cement plugs, it is desirable to do so with pipe smaller than the drill pipe, since its removal, after the cementing slurry has been pumped into place, does less to disrupt the ability of the cement to form a solid barrier in the well bore.

The number and size of pipe casing strings required for a well depends on the planned depth of the well and the pressures anticipated at the various subsurface levels in the area. Typically, deeper wells require a number of concentric strings of casing. The concentric strings of casing are run and cemented in progressively smaller hole sizes to line the newly drilled hole interval to contain the ever increasing pressures which normally occur in deeper rock layers. For example, a bit which is used to start the well at the surface may be 26 inches in diameter. The 26 inch bit is used to drill a hole or well bore of 26 inches in diameter down to the first casing setting level, where a 20 inch outside diameter (O.D.) casing is installed and cemented. A drill bit of 17½ inches in diameter would then be used to drill a 17½ inch diameter well bore down to the next required level, where a 13⅜ inch O.D. casing is installed and cemented. The next bit would be 12¼ inches in diameter to drill down to the next critical level, where a 9⅝ inch O.D. casing is installed and cemented.

The next bit size would be 8½ inches in diameter to drill down to the next casing level, where a 7⅝ inches O.D. casing is run and cemented, usually as a "liner," which is defined as a short casing string which covers only the open hole interval plus a small overlap into the bottom of the previous casing to save the expense of running the entire length of the 7⅝ inch O.D. casing back to the surface. A 6½ inch bit is then used to drill that size hole below the 7⅝ inch casing liner down to the next critical level, where a 5½ inch O.D. casing could also be run as a "liner."

If the objective zone has still not been reached, a 4⅝ inch bit is used to drill below the 5½ inch O.D. casing liner in preparation for a well completion in a still smaller casing size. From this example, it is evident that the annular space available between the bore hole and the casing or casing liner in deeper wells is very limited and a cleaning tool which can be used safely to aid in the successful primary cementation of casing under such limited clearance conditions is greatly needed in the oil and gas industry to improve the quality of well completions while reducing their ultimate cost.

Whether cementing casing or setting cement plugs, it is desirable for the walls of the well bore to be mechanically cleaned of uncirculatable mud media, sometimes called "mud cake." The formation of mud cake typically results from the loss of drilling fluid when circulating drilling mud in porous strata, such as porous rock, sandstone, limestone, or shale, during drilling operations. A portion of the fluid component of the drilling mud leaks into the surrounding strata, leaving behind a residue of drilling mud on the wall of the well bore, and thus forming the mud cake. Mud cakes can be cleaned from the well bore using abrading devices of cable or wire, known as "scratchers."

Cleaning the well bore prior to cementing operations prevents contamination of the cement slurry by the chemically treated drilling mud and permits better bonding of the cement to the cleaned bore hole. A number of such devices are discussed in the inventor's U.S. Pat. No. 4,750,558, which discussions are incorporated herein by reference.

In the inventor's U.S. Pat. No. 4,750,558, the inventor disclosed and claimed a well bore cleaning tool having a plurality of collars which could be slipped onto a pipe casing without welding, and then secured to the pipe casing using any conventional securing means, such as set screws. A cable was secured to the collars. The cable was disposed longitudinally on one side of the casing, substantially in a straight line. In a preferred embodiment, the tubes were secured to the collars using a series of tubes. The tubes had an inside diameter just slightly greater than the outside diameter of the cable.

The tubes in the '558 patent were spaced at approximately uniform intervals along the cable, and then crimped into an L-shape to secure them to the cable. The L-shaped tubes were placed in L-shaped cut-outs or cavities formed in the collars, and then tack welded into place. The collars were then attached to the casing using set screws. The distance between each successive collar was selected so that the cable would extend a sufficient distance outwardly from the casing to scratch the wall of the bore. For example, if the device was to be used to clean a large diameter bore, the collars were set closer together along the pipe casing, thus increasing the slack in the cable. Likewise, to clean a small diameter bore, the collars were set farther apart along the pipe casing, thus decreasing the slack in the cable.

Although the invention of U.S. Pat. No. 4,750,558 was successful in cleaning well bores; in close tolerance conditions, it was noted that in some very close tolerance conditions, it was necessary to place the cable even closer to the drill pipe than was previously possible. Additionally, in the invention of U.S. Pat. No. 4,750,558, the collars were placed such that the open ends of the L-shaped tubes were on a leading edge of the casing during rotation of the casing. This orientation facilitates frictional contact of the cable with the wall of the well bore. However, it was discovered that in some drilling conditions and applications, this orientation did not produce optimal results.

In view of the problems and shortcomings encountered with the arrangement of the foregoing designs, there is a need for an invention that overcomes the aforementioned problems and shortcomings.

OBJECTS AND SUMMARY OF THE INVENTION

It is an object of the invention to provide improved devices for cleaning well bores in close tolerance conditions.

It is another object of the invention to provide a well bore cleaning tool that holds a cable close to a drill pipe to provide improved cleaning of well bores in close tolerance conditions.

It is yet another object of the invention to provide an improved method of securing a cable to a well bore cleaning tool so as to facilitate operation in close tolerance conditions.

It is still another object of the invention to provide methods of cleaning well bores in close tolerance conditions using the improved devices.

These and other objects and advantages of the invention shall become apparent from the following general and preferred description of the invention.

Accordingly, a well bore cleaning tool adapted for close tolerance well bores is provided comprising a plurality of cylindrical collars carrying an elongated cable secured to the collars by a plurality of corresponding bent sleeves. The collars are adapted for detachable securing on a casing pipe in a vertically spaced apart relationship to each other. The collars are provided with a means for detachable securing of each of the collars to the casing pipe. The securing means preferably comprises a plurality of set screws extending through a wall of each of the collars, the screws being equidistantly spaced about the circumference of each of the collars.

Each of the collars is provided with a cutout. Each sleeve is fitted within a cutout in a corresponding collar. Each of the bent sleeves has open ends and forms an obtuse-angle channel. The obtuse-angle channels of the sleeves preferably define an angle of between about 110 and 120 degrees. Each sleeve is fixedly secured to a corresponding collar by a strip juxtaposed over an exterior surface of the sleeve, opposing ends of the strip extending beyond the cutout for attachment to the corresponding collar in a generally coplanar relationship to an exterior surface of the collar. The strip is preferably fixedly secured to a central bent portion of a corresponding sleeve and extends in a generally perpendicular relationship to a longitudinal axis of the corresponding collar.

The elongated cable is threaded through the sleeves of the collars such that the cable extends along and in close proximity to the casing pipe. The collars are spaced along the casing pipe to provide minimal slack to the cable extended between the collars. The cable extends from the open ends of the sleeves at certain angles relative to the collars and pipe casing. For example, the strip forms an acute angle with each of the open ends of the sleeve, such that the cable passing through the sleeve forms an acute angle with the longitudinal axis of the corresponding collar at the point of the cable's projection from the sleeve.

When extended along the pipe casing, the cable preferably exits each of the sleeve open ends at an angle of less than about twenty-five degrees relative to a tangent line passing through a point on an outer diameter of the sleeve's corresponding collar approximately where the sleeve opening intersects the outer diameter. The extended cable preferably exits each of the sleeve open ends at an angle of less than about twenty-five degrees relative to a line passing along the outer diameter parallel to a longitudinal axis of the pipe casing, the line being perpendicular to and intersecting the tangent line.

When rotated on a casing pipe in a well bore, the cable fictionally contacts an interior wall of the well bore to thereby effect cleaning of the well bore. In one method of use, the collars, are positioned on the pipe casing such that the open ends of the sleeves are on a trailing edge of the casing during clockwise rotation of the casing.

DETAIL DESCRIPTION OF THE PREFERRED EMBODIMENT

Figure 1:
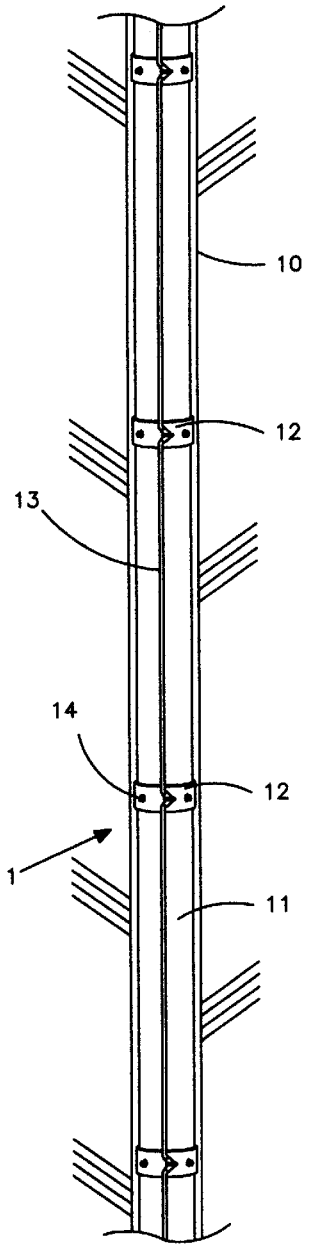
FIG. 1 is a side view of one embodiment of the invention showing the invention secured to a pipe casing in a well bore.

As shown in FIG. 1, the well bore cleaning tool 1 of the present invention comprises a plurality of cylindrical collars 12 carrying an elongated cable 13 secured to the collars by a plurality of corresponding bent sleeves 20. The collars 12 are adapted for detachable securing on a casing pipe 11 in a vertically spaced-apart relationship to each other, as shown in FIG. 1. The cylindrical walls of the collars 12 have an inner diameter 17 sized to closely encircle the casing pipe 11. The collars 12 are provided with a means 14 for detachably securing the collars 12 to the casing pipe 11.

Figure 4:
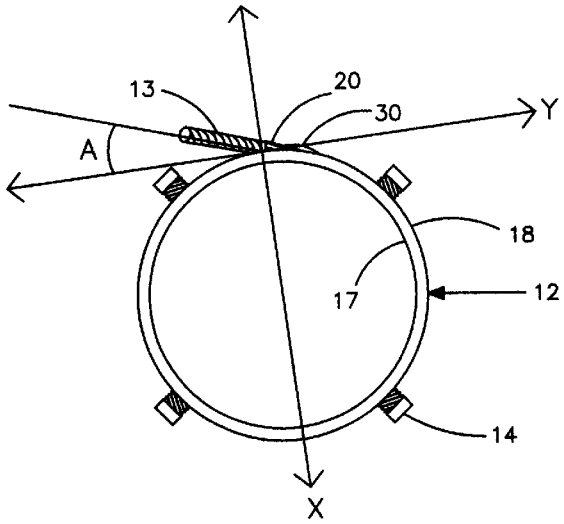
FIG. 4 is a side view of the embodiment of FIG. 3.

The securing means 14 preferably comprises a plurality of set screws 14 extending through a wall of each of the collars 12. The set screws 14 thread into threaded openings 15, to thereby permit the set screws 14 to be tightened down to engage an outer surface of the casing pipe 11. As shown in FIG. 4, the screws 14 are preferably equidistantly spaced about the circumference of each of the collars 12.

Figure 3:
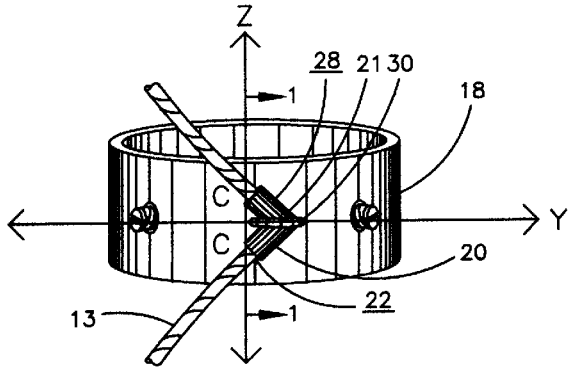
FIG. 3 is a further perspective view according to FIG. 2, further showing a sleeve and cable in relation to the cut-out of the collar.
Figure 2:
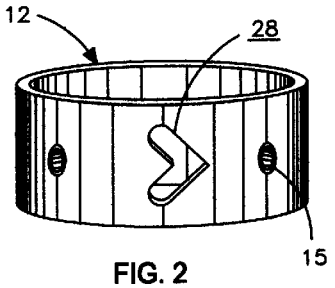
FIG. 2 is a perspective view of one embodiment of the collar component of the invention.

Each of the collars 12 is provided with a cutout 28. As shown in FIG. 2, the cutouts 28 are preferably heart-shaped. As shown in FIG. 3, each of the sleeves 20 is fixedly positioned in a corresponding cutout 28 of a collar 12. The bent sleeves 20 are relatively small; they may be about 1 to 2 inches in length.

Each bent sleeve 20 has open ends 22 for allowing the cable 13 to pass therethrough. Each sleeve 20, being a hollow body, forms an obtuse-angle channel. As shown in FIG. 3, the obtuse-angle channels of the sleeves 20 define an angle of ninety degrees or greater, and preferably of between about 110 and 120 degrees.

Figure 5:
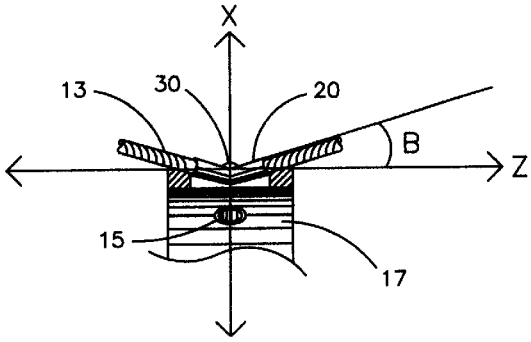
FIG. 5 is a sectional view taken along lines 1—1 of FIG. 3.

The sleeve 20 is secured to the collar 12 in such a manner that a central bent portion 21 of the sleeve 20 is disposed substantially entirely within the cutout 28. As shown in FIGS. 4 and 5, a portion of the open ends 22 of the sleeve 20 extends a minimal distance beyond the exterior surface 18 of the collar 12.

Each sleeve 20 is fixedly secured to a corresponding collar 12 by a strip 30 juxtaposed over an exterior surface of the sleeve 20. Opposing ends of the strip 30 extend beyond the cutout 28 for attachment to the corresponding collar 12 in a generally coplanar relationship to the exterior surface 18 of the collar 12. The strip 30 is fixedly secured to a central bent portion 21 of a corresponding sleeve 20, and extends in a generally perpendicular relationship to a longitudinal axis of the corresponding collar 12.

The strip 30 preferably forms an acute angle with each of the open ends 22 of the sleeve 20, such that the cable 13 passing through the sleeve 20 forms an acute angle with the longitudinal axis of the corresponding collar at the point of the cable's projection from the sleeve. In order to fixedly attach the sleeve 20 within the cutout 28 of the collar 12, the strip 30 is welded to the sleeve 20 and to the collar 12. The strip 30 is a welding bead or other type of metal that is capable of being welded to the sleeve 20 and the collar 12.

As shown in FIGS. 1 and 3, the elongated cable 13 is threaded through the sleeves 20 of the collars 12 such that the cable 13 extends along and in close proximity to the casing pipe 11 and frictionally contacts an interior wall of the well bore 10 during cleaning operations to thereby effect cleaning of the well bore 10 in close tolerance conditions. The inside diameter of the sleeves 20 is sized to closely fit the diameter of the cable 13, which can be as small as ¼ inch.

The sleeves 20, being fixedly secured to the collars 12 are fixedly spaced along the casing pipe at between two to four feet intervals. The central bent portion 21 of the sleeves 20 holds the sleeves 20 in the fixed intervals along the casing pipe 11, thereby securing the cable at the same intervals along the well bore 10.

In many close tolerance well bore cleaning operations, it is desirable to minimize the distance between the cable 13 and the pipe casing 11. As was previously known, this can be accomplished in part by spacing the collars 12 along the pipe casing 11 so as to provide minimal slack to the cable 13 extended between the collars 12. However, the well bore cleaning tool of the present invention allows the cable 13, when extended along the pipe casing 11, form a minimal slack and to lie as close to the collars 12 as possible.

Positioning the cable 13 as close as possible to the pipe casing 11 can be accomplished in part by making the walls of the collars 12 as thin as possible. In a preferred embodiment, the thickness of the wall of the collar 12, measured between the outside surface 18 and the inside surface 17 can be as little as ¼ inch. It is believed that a thinner wall would leave very little space within which to fit the sleeve 20 in the cutout 28, making it difficult to properly position the sleeve 20 within the cutout 28, and also making it difficult to securely weld the sleeve 20 to the collar 12.

Positioning the cable 13 as close as possible to the pipe casing 11 can be further accomplished by forming the cutout 28 at least slightly larger than the sleeve 20. A larger cutout 28 allows the sleeve 20 to be positioned substantially inside of or within the cutout 28, such that a portion of the sleeve 20 does not rest on the exterior surface 18 of the collar 12.

Because the cable 13 exits each open end 22 of a given sleeve 20 and then extends along, the exterior surface 18 of the corresponding collar 12, the cable 13 imposes some constraints on the positioning of the sleeve 20 within the cutout 28. In particular, the cable 13 makes it necessary to angle the sleeve 20 within the cutout 28, such that the open end 22 of the sleeve 20 extends slightly above the exterior surface 18 of the collar 12, as shown most clearly in FIGS. 4 and 5.

Positioning the cable 13 as close as possible to the pipe casing 11 can be further accomplished by positioning the sleeve 20 in the cutout 28 such that the cable 13, at the point where the cable 13 exits the open ends 22 of the sleeves, passes over a small open portion of the cutout 28. This arrangement permits the cable 13 to assume as small of an angle as possible as it exits the cutout 28 and passes over the exterior surface 18 of the collar 12. In order to accomplish this positioning of the cable 13 relative to the cutout 28, the cutout 28 is advantageously made at least slightly larger than the sleeve 20.

Positioning the cable 13 as close as possible to the pipe casing 11 can be further accomplished by fixing the sleeve 20 to the collar 12 using the welded strip 30 in the manner described above. The use of the strip 30 along the exterior surface 18 of the cable provides a strong weld, and also permits the sleeve 20 to occupy as much of the space of the cutout 28 as possible, thereby running the cable as close as possible to the exterior surface 18 of the sleeve 12.

As a result of the close positioning of the cable 13 relative to the collars 12 and pipe casing 11, the cable 13 forms certain angles in the region where the cable 13 exits the open ends 22 of the sleeves and passes over the exterior surface 18 of the collars 12. The angles formed by the cable 13 relative to the collars 12 and pipe casing 11 can be described in a number of ways.

The respective angles are described herein with reference to the tri-axes Cartesian coordinate system shown in FIGS. 3–5. In this system, the Y axis has arbitrarily been assigned to a line Y tangent to the exterior surface 18 of the collar, and passing through a point on the exterior surface 18 of the sleeve's 20 corresponding collar 12 approximately where the sleeve opening intersects the exterior surface 18. The X and Z axes pass through this point in respective perpendicular orientations to the Y axis.

As shown in FIG. 4, with the cable 13 extended along the casing pipe 11, the cable 13 exits each of the sleeve open ends 22 at an angle "a" of less than about twenty-five degrees relative to the tangent line Y. As shown in FIG. 5, the extended cable 13 exits each of the sleeve open ends 22 at an angle "b" of less than about twenty-five degrees relative to a line Z passing along the exterior surface 18 of the sleeve's 20 corresponding collar 12 parallel to a longitudinal axis of the pipe casing 11, the line being perpendicular to and intersecting the tangent line Y. As shown in FIG. 3, the cable forms an angle "c" with the tangent line Y passing through the strip 30 and looking through cross section of the collar 12.

The tool 1 of the present invention can be constructed by providing an elongated cable 13, threading the cable through a plurality of sleeves 20 (preferably five or six sleeves), and bending each of the sleeves 20 at selected intervals along the cable 13 to form an obtuse-angle channel in each of the sleeves, such that the channel fixedly holds the sleeves 20 on the cable 13 at the selected intervals. Each of the sleeves 20 is then fitted in a cutout 28 in a corresponding collar 12 and then welded to the collar 12.

Each sleeve 20 is welded to the corresponding collar 12 by placing a strip 30 over an exterior surface of the sleeve 20 such that opposing ends of the strip 30 extend beyond the cutout 28, and welding the strip 30 to the sleeve 20 and the corresponding collar 12 in a generally coplanar relationship to an exterior surface 18 of the collar 12.

In cleaning operations, the well bore cleaning tool 1 of the present invention is secured to a casing pipe 11 such that the collars 12 are in a vertically spaced apart relationship to each other, and such that the elongated cable extends along and in close proximity to the casing pipe, as shown in FIG. 1. The cable 13 is preferably aligned substantially in a straight line along the longitudinal axis of the pipe casing 11, as shown in FIG. 1.

Alternatively, the cable 13 can be aligned such that the cable 13 coils around the pipe casing, preferably making one revolution or less. The casing pipe 11 and the attached well bore cleaning tool 1 are then inserted into a close tolerance well bore 10 using procedures well known to those of ordinary skill in the art.

When the tool 1 has been properly positioned in the close tolerance portion of the well bore where cleaning operations are to be carried out, the casing pipe 11 is rotated in a clock-wise direction (when viewed from above), such that the cable 13 frictionally contacts an interior wall of the well bore 10 to thereby effect cleaning of the close tolerance well bore 10.

It was previously thought that the collars 12 should be positioned on the pipe casing 11 such that the open ends 22 of the sleeves 20 are on a leading edge of the casing 11 during clockwise rotation (when viewed from above) of the casing 11. This orientation provides a strong cleaning action.

However, in some conditions, it has been found to be advantageous to position the collars 12 on the pipe casing 11 such that the open ends 22 of the sleeves 20 are on a trailing edge of the casing 11 during clockwise rotation of the casing 11. This orientation provides a less abrasive cleaning action, and provides favorable results in some drilling conditions, particularly when used with the close tolerance well bore cleaning tool 1.

Although the present invention has been described in terms of specific embodiments, it is anticipated that alterations and modifications thereof will no doubt become apparent to those skilled in the art. It is therefore intended that the following claims be interpreted as covering all such alterations and modifications that fall within the true spirit and scope of the invention.

I claim:

1. A well bore cleaning tool adapted for close tolerance well bores comprising:

a plurality of cylindrical collars adapted for detachable securing on a casing pipe in a vertically spaced apart relationship to each other, each of said collars being provided with a cutout;

a plurality of bent sleeves with open ends, each sleeve being fitted within a corresponding cutout in a collar, each sleeve forming an obtuse-angle channel, each sleeve being fixedly secured to a corresponding collar by a strip juxtaposed over an exterior surface of said sleeve, opposing ends of said strip extending beyond said cutout for attachment to said corresponding collar in a generally coplanar relationship to an exterior surface of said collar; and an elongated cable threaded through said sleeves of said collars to extend along and in close proximity to said casing pipe and frictionally contact an interior wall of the well bore to thereby effect cleaning of the well bore.

2. The apparatus of claim 1, further comprising means for detachable securing of each of said collars to said casing pipe.

3. The apparatus of claim 2, wherein said securing means comprises a plurality of set screws extending through a wall of each of said collars, said screws being equidistantly spaced about the circumference of each of said collars.

4. The apparatus of claim 1, wherein said strip is fixedly secured to a central bent portion of a corresponding sleeve and extends in a generally perpendicular relationship to a longitudinal axis of the corresponding collar.

5. The apparatus of claim 4, wherein said strip forms an acute angle with each of the open ends of said sleeve, such that the cable passing through said sleeve forms an acute angle with the longitudinal axis of the corresponding collar at the point of the cable's projection from said sleeve.

6. The apparatus of claim 1, wherein said collars are spaced along said casing pipe to provide minimal slack to said cable extended between said collars.

7. The apparatus of claim 6, wherein said extended cable exits each of said sleeve open ends at an angle of less than about twenty-five degrees relative to a tangent line passing through a point on an exterior surface of said sleeve's corresponding collar approximately where said sleeve opening intersects said exterior surface.

8. The apparatus of claim 7, wherein said extended cable exits each of said sleeve open ends at an angle of less than about twenty-five degrees relative to a line passing along said exterior surface parallel to a longitudinal axis of the pipe casing, said line being perpendicular to and intersecting said tangent line.

9. The apparatus of claim 6, wherein said extended cable exits each of said sleeve open ends at an angle of less than about twenty-five degrees relative to a line passing along an exterior surface of said sleeve's corresponding collar parallel to a longitudinal axis of the casing pipe, said line being perpendicular to and intersecting a tangent line passing through a point on said exterior surface where said sleeve opening intersects said exterior surface.

10. The apparatus of claim 1, wherein said obtuse-angle channels of said sleeves define an angle of between about 110 and 120 degrees.

11. A method of cleaning a close tolerance well bore comprising:

providing an elongated cable threaded through a plurality of sleeves, each of said sleeves being bent at selected intervals along said cable to form an obtuse-angle channel in each of said sleeves to hold said sleeves on said cable at the selected intervals, said sleeves being carried by a corresponding of a plurality of cylindrical collars adapted for detachable securing on a casing pipe in a vertically spaced apart relationship to each other, each of said collars being provided with a cutout and each of said sleeves being fitted in a cutout of a corresponding, each sleeve being secured with a corresponding collar by a strip placed over an exterior surface of said sleeve, opposing ends of said strip extending beyond said cutout for attachment to said corresponding collar, each strip being fixedly attached to a corresponding collar in a generally coplanar relationship to an exterior surface of said collar;

securing said collars on a pipe casing in a vertically spaced apart relationship to each other such that said elongated cable extends along and in close proximity to said casing pipe;

inserting said pipe casing into the close tolerance well bore; and rotating said pipe casing to allow said cable to frictionally contact an interior wall of the well bore to thereby effect cleaning of the close tolerance well bore.

12. The method of claim 11, wherein said strip is fixedly secured to a central bent portion of a corresponding sleeve and extends in a generally perpendicular relationship to a longitudinal axis of the corresponding collar.

13. The method of claim 11, wherein said strip forms an acute angle with each of the open ends of said sleeve, such that the cable passing through said sleeve forms an acute angle with the longitudinal axis of the corresponding collar at the point of the cable's projection from said sleeve.

14. The method of claim 11, wherein said collars are spaced along said casing pipe to provide minimal slack to said cable extended between said collars.

15. The method of claim 14, wherein said extended cable exits each of said sleeve open ends at an angle of less than about twenty-five degrees relative to a tangent line passing through a point on an exterior surface of said sleeve's corresponding collar where said sleeve opening intersects said exterior surface.

16. The method of claim 15, wherein said extended cable exits each of said sleeve open ends at an angle of less than about twenty-five degrees relative to a line passing along said outer diameter parallel to a longitudinal axis of the pipe casing, said line being perpendicular to and intersecting said tangent line.

17. The method of claim 14, wherein said extended cable exits each of said sleeve open ends at an angle of less than about twenty-five degrees relative to a line passing along an outer diameter of said sleeve's corresponding collar parallel to a longitudinal axis of the pipe casing, said line being perpendicular to and intersecting a tangent line passing through a point on said outer diameter where said sleeve opening intersects said exterior surface.

18. The method of claim 11, wherein said obtuse-angle channels of said sleeves define an angle of between about 110 and 120 degrees.

19. The method of claim 11, wherein said collars are positioned on said pipe casing such that said open ends of said sleeves are on a leading edge of the casing during clockwise rotation of the casing.

* * * * *